United States Patent [19]

Lobb

[11] Patent Number: 4,731,047

[45] Date of Patent: Mar. 15, 1988

[54] APPARATUS FOR MAKING FILTER FRAMES

[75] Inventor: David R. Lobb, Pomeroy, Pa.

[73] Assignee: A. G. Custom Machine Co. Inc., Scranton, Pa.

[21] Appl. No.: 887,338

[22] Filed: Jul. 21, 1986

Related U.S. Application Data

[63] Continuation of Ser. No. 646,450, Aug. 31, 1984, abandoned.

[51] Int. Cl.[4] ..... B31B 1/00

[52] U.S. Cl. ..... 493/10; 493/22; 493/354; 493/355; 493/360; 493/399; 493/941; 83/357; 83/406

[58] Field of Search ..... 144/3 R, 367; 493/10, 493/14, 15, 18, 23, 30, 35, 57, 60, 61, 62, 74, 82, 72, 83, 160, 237, 342, 356, 357, 360, 354, 355, 12, 29, 69, 71, 77, 79, 81, 178, 358, 359, 362, 364, 399, 403, 941, 21; 55/310; 83/300, 356.1, 357, 406, 917

[56] References Cited

U.S. PATENT DOCUMENTS

| | | | |
|---|---|---|---|
| 2,102,170 | 12/1937 | Stern | 83/917 |
| 2,161,831 | 6/1939 | Manning | 156/264 |
| 2,393,419 | 1/1946 | Schaat | 52/658 |
| 2,965,197 | 12/1960 | Dow et al. | 55/D31 |
| 3,654,830 | 4/1972 | Werner, Jr. | 83/406 |
| 4,061,326 | 12/1977 | Proudman | 493/14 |
| 4,210,067 | 7/1980 | Evans, Jr. | 55/D5 |
| 4,471,641 | 9/1984 | Mitchell | 83/300 |

*Primary Examiner*—Frederick R. Schmidt
*Assistant Examiner*—Robert Showalter
*Attorney, Agent, or Firm*—Anthony J. Dixon

[57] ABSTRACT

An apparatus for the production of frames for filters from a continuing reel of framestock, each frame having a given length and width determined by a preset cutting and corner notching function and each frame having a prefolded cross section or a pinched cross section, said frames made to accommodate filter material of the type normally used to filter air.

7 Claims, 10 Drawing Figures

APPARATUS FOR MAKING FILTER FRAMES

CROSS REFERENCE TO PRIOR APPLICATIONS

The present application is a continuation of application Ser. No. 06/646,450 filed Aug. 31, 1984, now abandoned.

BACKGROUND OF THE INVENTION

1. Field of the Invention

The present invention relates to the manufacture of frame for filters. More particularly it relates to frames for air filters of the type normally used in forced-air heating systems, air conditioning systems and the like. More particularly, the present invention relates to the apparatus for constructing rectangular frames for use with air filters used to remove impurities from a moving stream of air.

2. Description of the Prior Art

In the field of air cleaning, generally, it is common to use disposable filters which comprise a filter mat and a frame. Often these frames are manufactured by an assembly-line manual cutting technique. Automation for combining the filter material with pre-formed blanks is known, such as shown on U.S. Pat. No. 4,210,067 issued to Alton Evans, Jr., however, a method for constructing the filter frame to meet specific size requirements is not disclosed therein. A method and apparatus is therefore needed to form frames of a custom size for each particular application.

The same shortfall in the art can be seen in U.S. Pat. No. 2,161,831 issued to F. Manning where a metallic frame closes a filter unit of a channel configuration. Yet the automated pre-cutting to a particular and variable size is lacking in this disclosure.

The preformed material shape for a filter frame is discussed in U.S. Pat. No. 2,393,419 issued to O. H. Schaff; however, no mechanized automated method for forming this shape is disclosed.

The field, therefore, is in need of an automated frame forming apparatus and method to provide the frame shape required to construct a frame for filter material.

There is a further need in the art to provide a method and apparatus which will manufacture a frame of a given size in a given amount with minimum waste of raw materials.

It is therefore, an object of the present invention to provide an apparatus and method to construct the filter frame long needed in the art.

It is a further object of the present invention to provide the air filter industry and field of art a filter frame-forming device which is easy to set-up, operate and maintain while providing versatility to a wide range of filter sizes and for filters of various thicknesses.

It is a further object of the inventor to provide an apparatus and method for forming frames for filters directly from a mill roll of raw materials such as chipboard or the like, to allow construction of a small amount to a large amount of filter frames with ease, efficiency and minimum material waste.

It is a further object of the invention to provide such a device with complete safety protection to the operator, automated jam control, minimal day-to-day maintenance and quickly replaceable parts.

These and other objects of the invention will become clear upon review of the summary of the invention, drawings and description which follow.

SUMMARY OF THE INVENTION

To achieve the stated objects and advantages set forth herein and in accordance with an embodiment of the invention, an apparatus and method for formation of frames for filters is provided wherein:

a. Framestock, such as chipboard is fed into the apparatus through infeed means and passes through the device at a given speed;

b. said material is guided through the machine by guide means such as rails;

c. a length of the material is drawn into the machine by feeding means such as rollers;

d. said material passes through opposing rollers to bend it and form a bend at a given location along its length;

e. in certain applications, the material passes through a second set of opposing rollers to score it at a given location along its length;

f. a first notch is cut at a location of preset length from the leading edge by automated cutting means;

g. a second notch is cut at a predetermined distance from said first notch;

h. a third notch is cut at a predetermined distance from said second notch;

i. the stock is cut through at a given distance from said third notch thereby reinitializing the cycle for the next filter;

j. the length of material of a predetermined length with three spaced notches passes through opposing rollers which fold it to the size setting of the fold rolls and is discharged to an outlet or discharge surface.

The apparatus further provides means for pinch-scoring the material fed along its entire length by passing said material through a set of opposing pinch-score rollers which are engaged when a pinch-type frame is desired.

At the outlet end of the apparatus, the material passes through a final set of rollers which use a cross-sectional fold in the precut material.

The set of rollers, both pinch-score rollers and fold rollers will be better understood after review of the drawings and disclosure of the preferred embodiment.

DESCRIPTION OF THE DRAWINGS

FIG. 4(*b*) is a cross-sectional view of the filter frame material pinched and folded manually.

FIG. 4(*c*) is a cross-sectional view of the filter frame material pinched by the present invention only.

DESCRIPTION OF THE PREFERRED EMBODIMENT

With reference to the drawings, a completed description of the preferred embodiment following a frame construction from mill roll stock to completion, follows.

Raw material for frame construction is received, usually in rolls from the mill. Such stock is often a chipboard material of standard construction. As this material passes through the apparatus of the present invention, it is scored, notched, folded and cut to predetermined dimensions. It is noted that finished filter thickness of about one-half inch to about two inches, either pinch-type or square cross-section.

Initially, the mill roll is placed on the mill roll spindle, 4 which is attached to the main frame, by the mill roll support, 2. The mill roll guides, 3 maintain the roll and its infeed into proper alignment.

The material unwinds from the roll and is fed into infeed rollers, 21 and 22. These are rotationally mounted opposing rollers which draw the mill stock into the apparatus. Upon initial start up the feedstock passes between these rollers which are mounted on shafts, 71 and driven via chain, 14. Encoder, 70 is attached to shaft, 71 and pulses 1000 times per shaft revolution which equates to 0.00941" of stock movement.

After passage through rollers, 21 and 22, the material passes between rollers, 23 and 24 which are pinch score rollers. At this stage, the feedstock is scored if desired. These rollers csn be engaged by operation of lever, 56 and shaft 57 if pinch-type frame is desired. The rollers themselves are opposing with top roller, 23 containing a circumferential protusion which is accommodatingly larger than the circumference of the lower rollers, 24. When engaged the material passing between is thereby scored. All rollers except for the upper pinch-score rollers, 23, are driven by shafts which are in turn driven by drive chains. In the case of roller, 24, the shaft is shown at location 62 and is driven by drive chain, 14.

Figure 6:
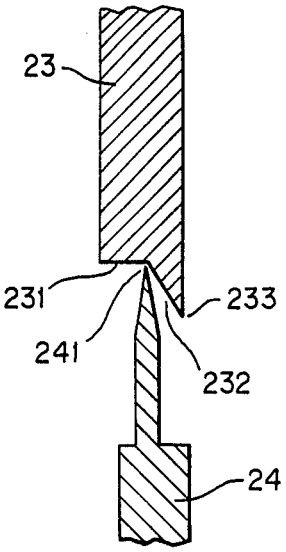
FIG. 6 is a cross-sectional view of the pinch-score rollers.
Figure 7:
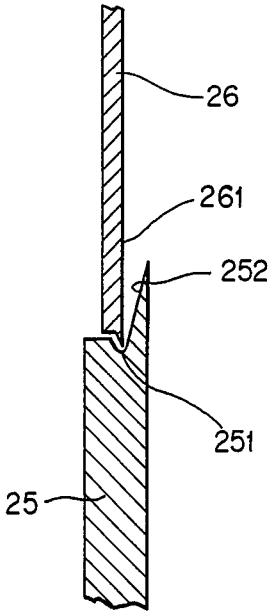
FIG. 7 is a cross-sectional view of the fold rollers.

More particularly, as shown in FIG. 6, the pinch-score rollers are designed to score and bend the material along its length at about ⅜" in from each edge. This score is required when pinch style filters are to be made.

The lower pinch-score rollers, 24, have a sharp edged circumference, 241. As the material passes through the pinch-score rollers, these rollers score it.

Figure 4A:
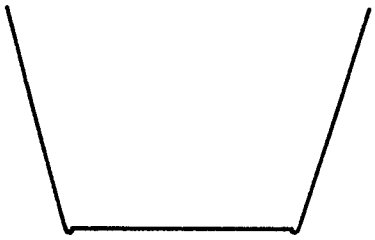
FIG. 4(*a*) is a cross-sectional view of the filter frame material unpinched.
Figure 4B:
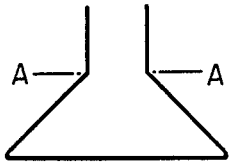
Figures 4C, 5:
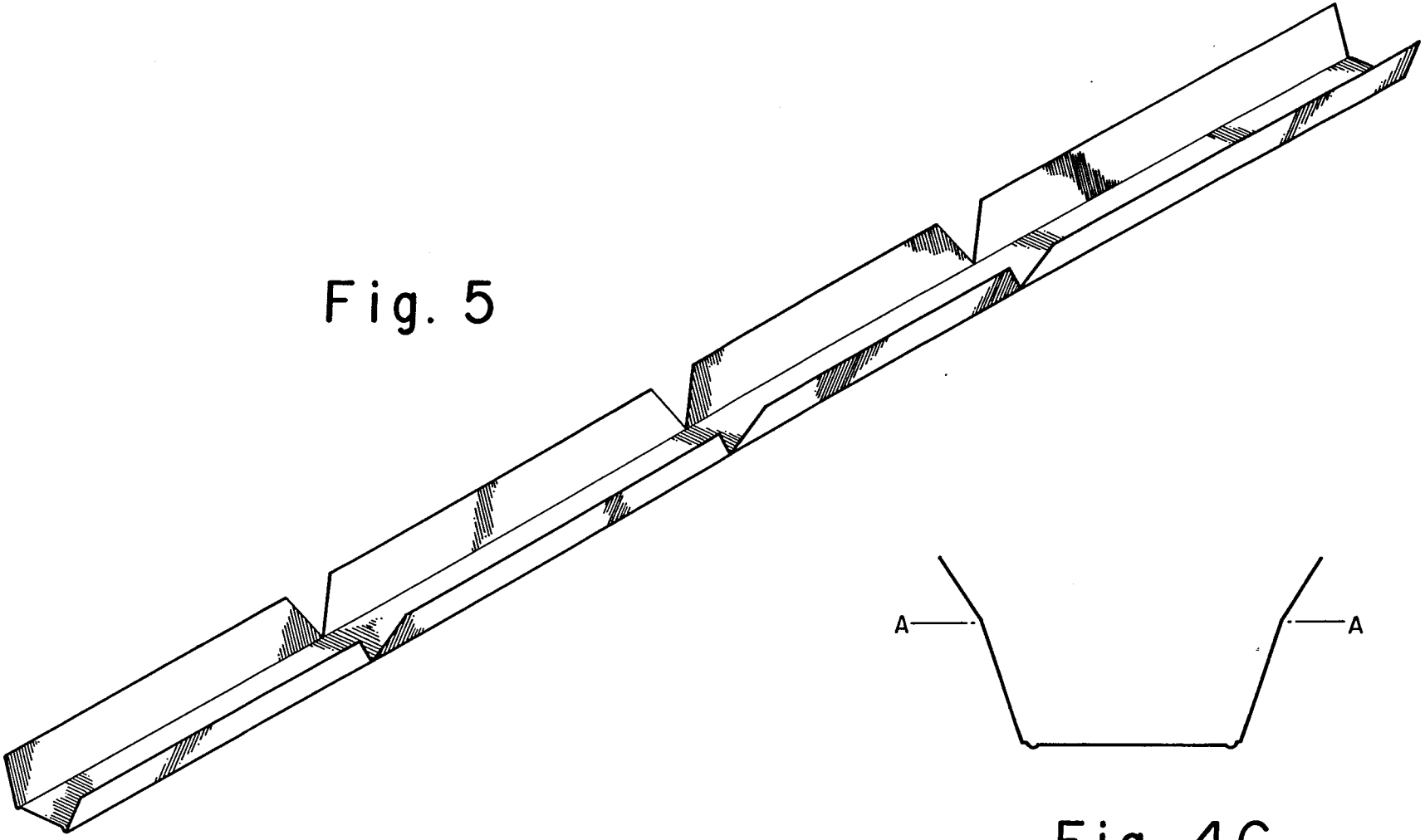
FIG. 5 is a perspective view of a complete frame, unfolded.

The upper pinch-score rollers, 23 have a flat minor diameter, 231 and a beveled edge, 232 between the minor and major, 233 diameters as shown in FIG. 6. The lower rollers align with the upper rollers where the beveled edge, 232 meets with minor diameter, 231. The flat diameter on the upper rollers backs up the material so the lower rollers can score it. The beveled edge bends the material as shown in FIG. 4(*c*) at location A—A. After the material leaves the machine it can then be manually folded easily to the configuration shown in FIG. 4(*b*).

It should be noted that the upper pinch-score rollers are not powered. Also, note the lower pinch-score rollers, 23, are powered through a friction-slip clutch arrangement, see FIG. 3. This is necessary to keep the pinch-score rollers from driving the material when the infeed rollers, 21 and 22 drop during the length knife cut, 31 and 32, as described further below.

The pinch-score rollers are rotationally mounted to the guide rails, 73 and move with them when they are adjusted. They are keyed to their shafts but are allowed to slide on them.

The chain itself is driven via interaction of the drive chain and the main motor, 11, through jack shaft, 611 turning in bearings, 61.

The material approaches length knives, 31 and 32 which cut the material through to start the process. The knife cut is made by opposing blades as shown which are driven by air cylinder, 16 and controlled by solenoid valve, 69. The activation of the cutting action is interconnected to feed rollers relax slightly so as to cause a gap in material flow.

A photoelectric eye, 74 is positioned directly beyond the length knives. When it "sees" this gap, the entire control mechanism is reset denoting a new frame being started. When the material flows past eye, 74, the receiver is blocked and controllers, 81 through 84 are activated. These are length controllers which are preset to desired frame dimensions. As material passes through the machine and under corner knives, 17 supported by arm, 2 7, the controller advances to its preset position. At the moment the setting is reach, knives, 17 are activated and remove triangular notches from the material—see FIG. 5 where notches are shown. At that point the second controller, 82 will begin to advance to a preset position. When reached, the knives, 17 make the second notch. The corner knives, 17 on the present invention travel approximately 271 feet per minute. The frame material travels approximately 60 feet per minute. The corner knives, 17 cut the material while it is moving but due to the speed difference the duration of contact is very short. A slight buckle is noticed in the material as the knives, 17 cut but there is no damage to the material and the cut is very clean. This is repeated once more with a third notch and controller, 83. A last length controller, 84 then begins to guage the final length. Upon reaching its setting, the length knifes, 31, 32 will cut thereby finishing one frame and beginning the next. The waste is therefore kept to a minimum. It will be noted from the drawings that the corner knives, 17 operate against base knives (two on each side), 33 and 34 which are supported by supports, 35 and 36 attached to side plates, 29 and 30.

A final set of rollers, 25 and 26 (two sets, only left shown) the fold rollers, are provided for the final fold of the material to its desired cross-sectional configuration. The rollers interact as follows:

The fold rollers are designed to fold the material along a path selected by the width setting of the machine. Further, they are designed to form a bead at the fold. The bead so formed has three purposes:

1. to reduce breakage of the material at the fold,
2. to make the fold less rigid to make it easier for the operators to insert the filter media,
3. to improve the appearance of the finished filter.

Figure 1:
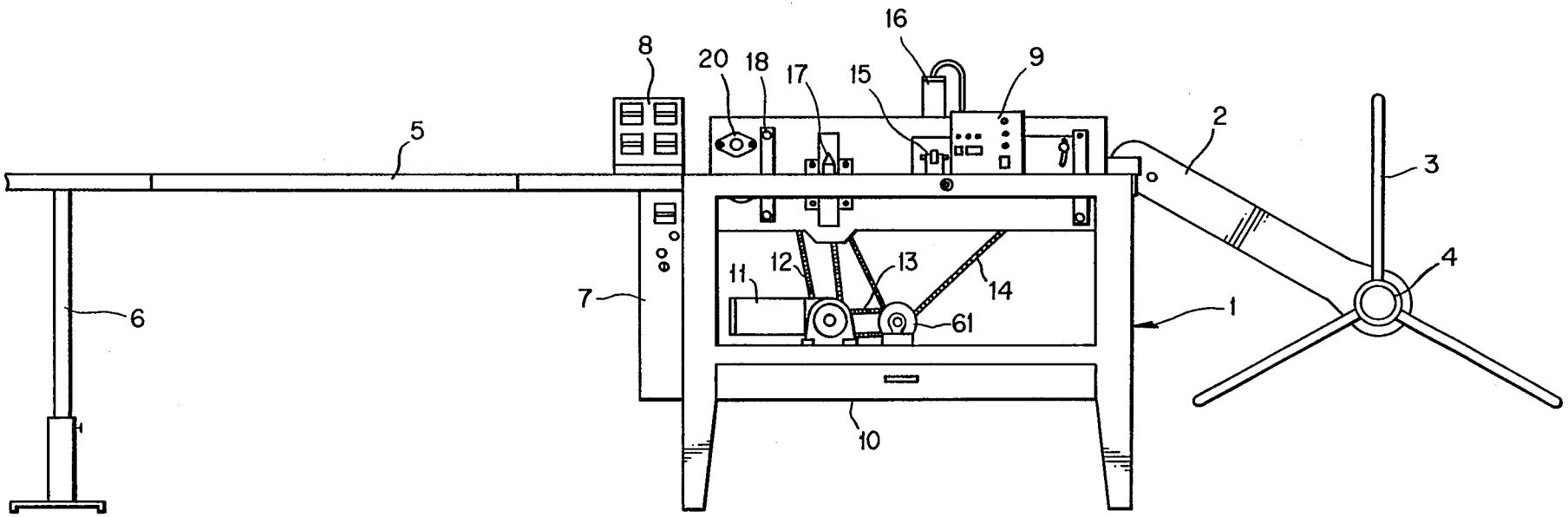
FIG. 1 is a side schematic view of the apparatus of the invention.
Figure 2:
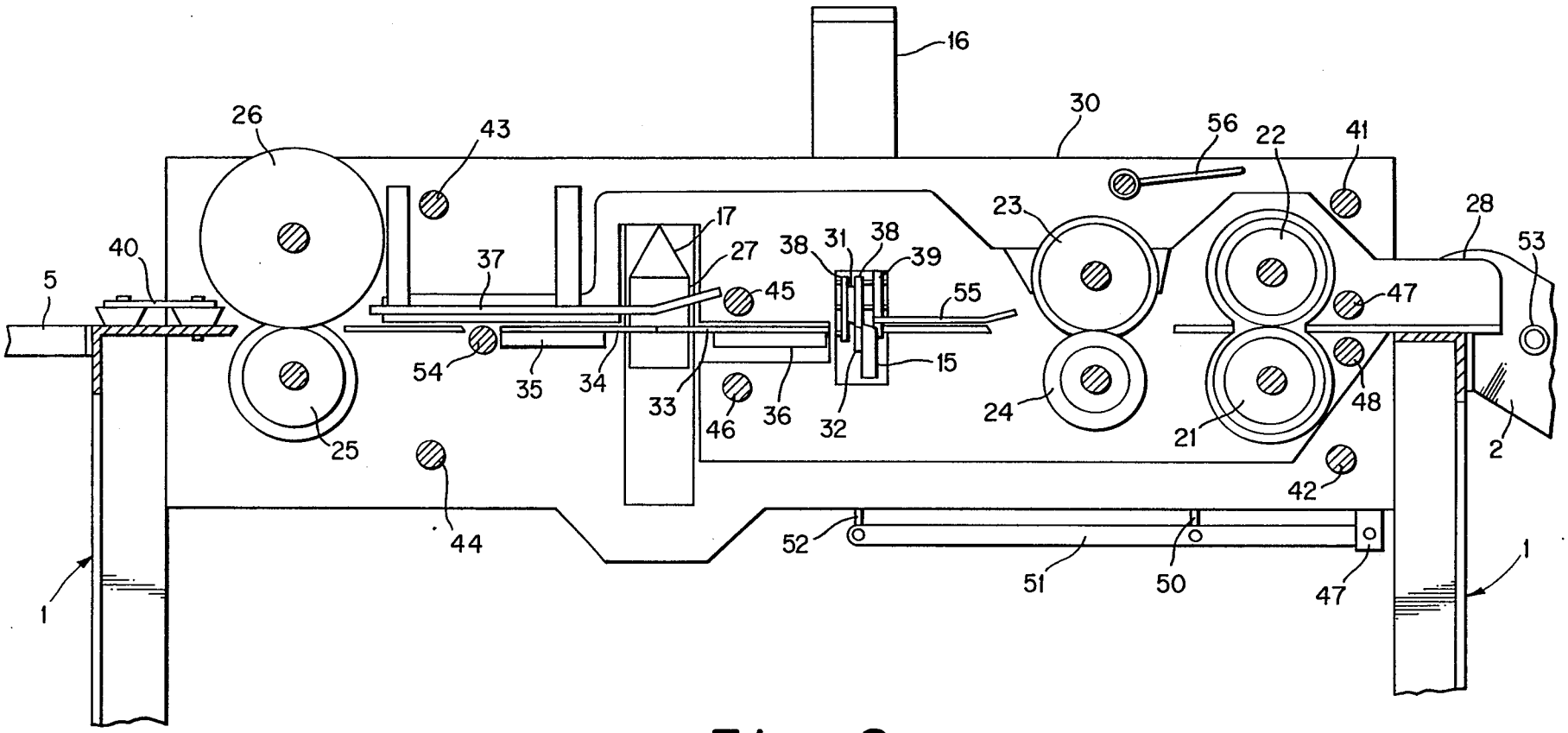
FIG. 2 is a side sectional view of the apparatus.

The upper fold rollers, 26 are knurled to prevent the material from slipping while being driven through as shown in FIG. 2 resulting in the workpiece being transferred to discharge table, 5. They are larger in diameter than the lower fold rollers to allow the folded material to clear the upper fold rollers shaft. A protrusion, 261 forming the major diameter of the rollers, 26 forces the material into the groove, 251 in the lower fold roller, 25. This is what forms the bead.

The lower fold rollers, 25 have a groove, 251 around the minor diameter. This groove receives the material as forced into it by the upper fold rollers to form the bead as described. The inside edge between the major and minor diameters is beveled, 252. This beveled side, 252 folds the material.

The upper and lower fold rollers, 25 and 26 on the right side of the machine are connected to their respective shafts and are stationary. The left upper and lower fold rollers are fastened to bearings attached to the left side plate, 29 which is movable. They are keyed to their respective shafts but are allowed to slide. Adjusting the side plate, 29 changes the distance between the fold rollers. This is the width adjustment. This is shown on FIG. 3.

The four folding rollers, 40 at the discharge end of the machine have three functions:

1. to further fold the material as the material passes through,
2. to prevent the material from twisting upon discharge from the fold rollers,
3. to prevent the frames from telescoping until they are completely out of the machine.

The folding rollers on the right are stationary. The left rollers are attached to the left side plate and move with the width adjustment.

Upon completion, the precut, folded frame is discharged onto table, 5 connected to frame, 1 and supported by leg, 6.

It is necessary, to practice the invention, that one understands the control scheme of the apparatus. Each of the above functions as described in one cycle, is operated by the following control mechanism.

A main electrical panel, 7 is positioned on the machine along with the length controllers, 81–84. The main panel contains an on-off switch which turns off power to all controls.

Also provided is a jog-run switch and jog-start button which allows either continuous motor running or running only with depression of jog-start button. The, emergency stop button is provided to protect against accidental starts.

An eject system switch will activate the length knife and release infeed roller, 21 as to clear material from the machine. A control is also provided to turn off the corner knives. The length knife can be turned off also.

The main controllers are the batch counter and the length controllers, 81–84. The batch counter is located along side panel 7 and is used to control the number of frames in a given run. It advances as each length is cut so as to stop the machine when a given number is achieved. The length controllers are located at location 8 and are four in number, 81, 82, 83 and 84. Each has the functions previously described and is numerically achieved. The actual setting required for given lengths or frame dimensions are as follows:

The overall length controller count pulses from encoder, 70. Each is set to a number which corresponds to a given length. In the present embodiment, due to the distance between the length knife and corner knife and the distance between pulses of 0.00941" the first controller must be set at a setting plus 402 and the last controller at a setting less than 525.

First frame size in inches is determined to convert to pulses, divide the length by 0.00941. Round off and set on second controller, 82. Subtract 525 from that setting and set the last controller 84 to the resulting number.

Next convert width to pulses by dividing by 0.00941. Set controller, 83 the third controller to that number. Add 402 and set controller, 81 to the resulting number.

Recall that controller, 81 controls leading edge to first corner distance; 82 controls first to second notch; 83 controls second to third notch and 84 controls third notch to end cut. For example:

CHART 1

| | |
|---|---|
| Frame size: 10" × 18" | Frame size: 7 1/16" × 9 1/16" |
| 18 is divided by .00941 = 1912 | 7.0625 divided by .00941 = 750 |
| set 82 to 1912 | set 82 to 0750 |
| 1912 − 525 = 1387 | 750 − 525 = 225 |
| set 84 to 1387 | set 84 to 0225 |
| 10 divided by .00941 = 1062 | 9.0625 divided by .00941 = 963 |
| set 83 to 1062 | set 83 to 0963 |
| 1062 + 402 = 1464 | 963 + 402 = 1365 |
| set 81 to 1464 | set 81 to 1365 |

These setting are exact plus or minus 0.010". To decrease the size, deduct from the setting. Each number equals 0.00941. If numbers are subtracted from 81 and the same amount must be subtracted from 83. If numbers are subtracted from 82 the same amount must be subtracted from 84.

Various mechanical configurations can be used to mount the various elements of the instant apparatus to a frame. The balance of the preferred embodiment disclosure is meant to describe on configuration but not to limit the present invention to it.

Note, at the mill roll side of the apparatus, a roller, 53 is provided to guide the stock. The roller is rotationally mounted to the frame. Base guides, 72 are also provided along with side guide rails, 73 and 28. The width can be adjusted via screws, 41 and 42 in the front and 43 and 44 at the rear, to accommodate feedstock and frame width. These are supported by screw supports, 18 and 19 as shown. The entire configuration is further attached to side plates, 29 and 30 to provide stability. The guide rails, 73 and 28 are supported by shafts, 45 and 47 and are adjusted by screws, 46 and 48 respectively.

Figure 3:
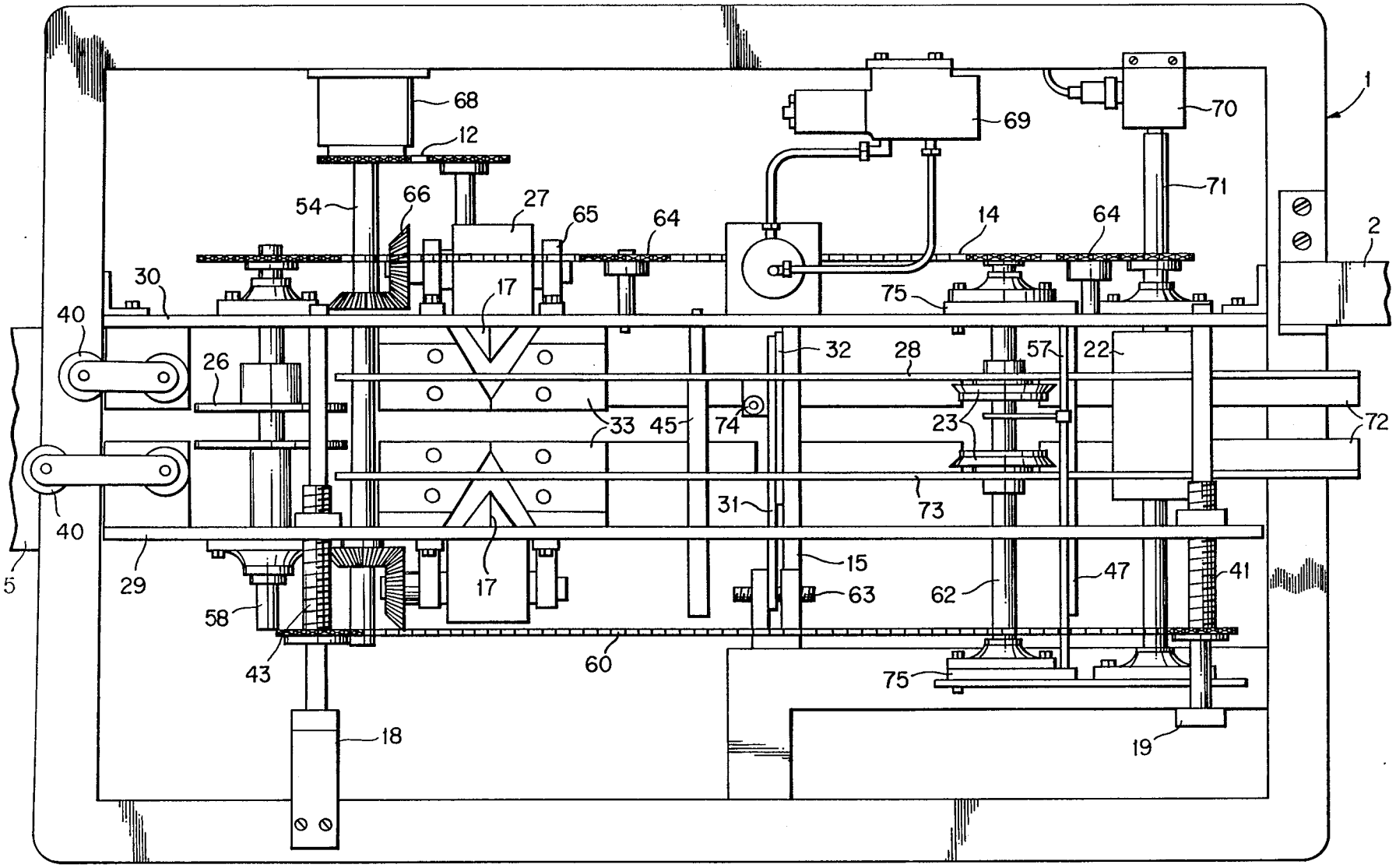
FIG. 3 is a top sectional view.
Figure 8:
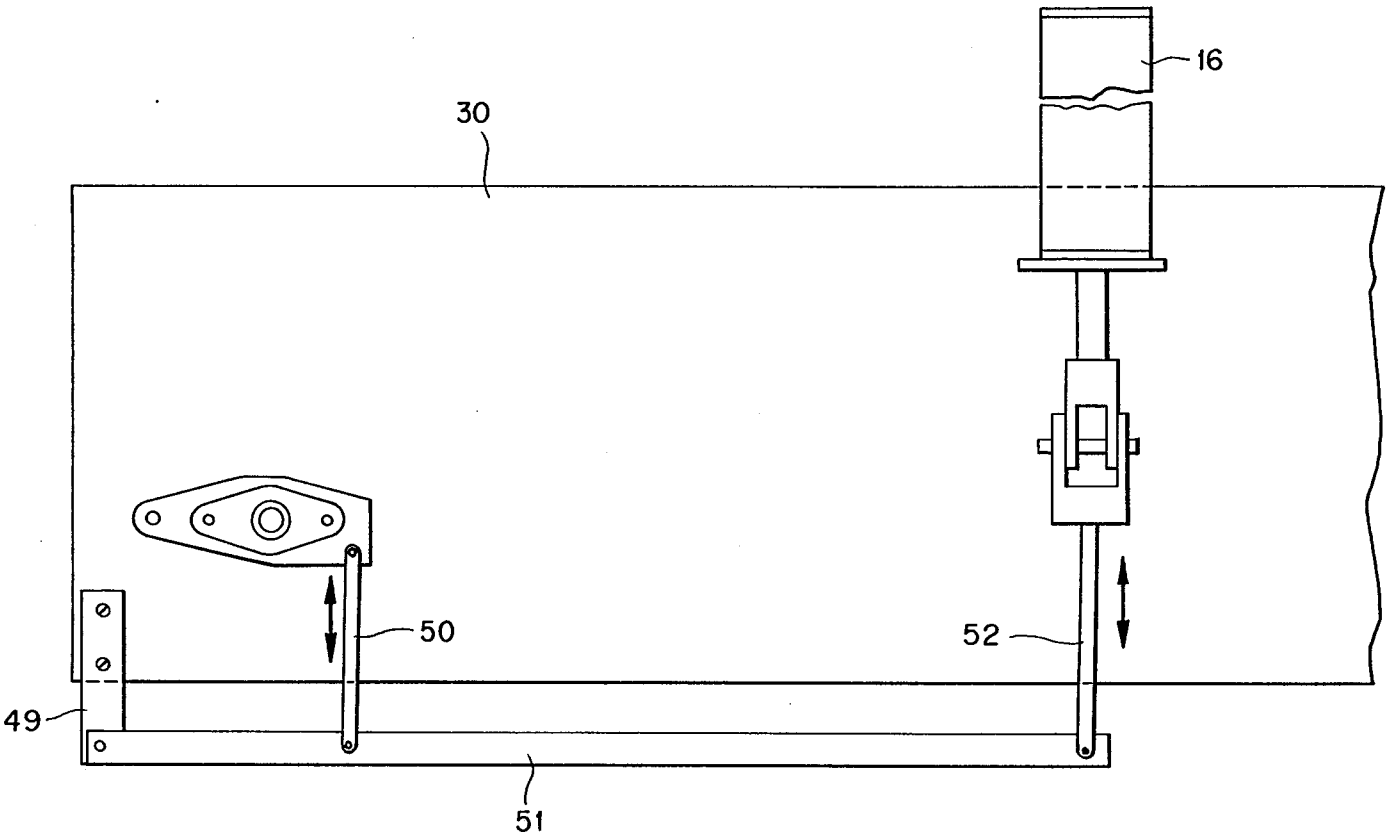
FIG. 8 is a schematic diagram of the infeed roller mechanism.

Hold down rail, 37 keeps the feedstock in position and is mounted in proximity to corner knive, 17. Guides, 55 position the material as it approaches hold down rail, 37 and knives, 31 and 32. The knife is driven by chain, 12 and miter gears, 66 via engagement clutch, 68. It is a conventional chain-clutch-shaft-gear configuration as shown in FIG. 3. Also note bearings, 65 which supports the miter gear shaft. Elements, 49, 50, 51 and 52 as shown, allow for infeed rollers releases as follows: (See FIG. 8)

The lower infeed roller, 21 is mounted on self-aligning bearings. The left bearing is mounted to the machine frame, 1. The right bearing is mounted on a pivot plate (not shown on drawing). The infeed roller releases arm, 51 pivots on bracket, 49. Arm link, 50 connects the bearing pivot plate to the release arm. Cylinder link, 52 connects the release arm to the air cylinder. When the air cylinder pushes the knife, 31 and 32 down to cut, it also pushes down on link 52. This in turn pushes the release arm down pulling link, 50 down. When link, 50 pulls the pivot plate down the lower infeed rollers, 21 drop as noted above releasing its grip on the material. When the air cylinder pulls back up this mechanism returns the infeed roller to its driving position. Note however, that the rollers, 21 keep turning only they cannot feed material since contact has been eliminated due to the dropping action.

The length knives, 31 and 32 are supported in element, 15. Also mounted thereon are gibs, 38 set in gib frame, 39. Adjustments to knife blade positions can be made via screw, 63.

The entire device is enclosed in Lexan, unbreakable polycarbonate so that no human contact can be inadvertently made with any of the moving parts. Between motor, 11, a drawer, 10 is positioned wherein chips cut at beginning of each series of cuts may fall and be collected. They can be safely removed by opening the drawers.

Actual operation of the complete device proceeds as follows:

1. Remove one mill roll guide, 3 from the mill roll support, 2 and place the desired mill roll on the spindle, 4. Mill roll should be installed so the inside is facing up when running through the machine. Replace the mill roll guide, 3 but do not tighten.

2. Using the hand crank, not shown, turn the guide rail adjusting shaft fully counter-clockwise. The guide rail adjusting shaft is located below and just to the left of the operator's panel. Access is through the hole in the frame.

3. At this point, the width has to be set for the size frame to be run. The width adjusting shaft, 21 is located just below the top frame near the front of the machine. Access is through the hole in the guard. Using the hand crank, turn the shaft to adjust the fold rollers to the desired width; clockwise to increase, counter-clockwise to decrease. A scale may be used to measure the fold rolls outside to outside. Once the desired width is set, the width bar may be marked for future use. The marks stamped on the bar are reference points for ½", 1" and 2" frames.

4. Hold the end of the mill roll between the guide rails, 73 at the bsck of the machine. Turn the guide rail adjuting shaft, 46 clockwise until the guide rails are just touching the material. The guide rails should be tight enough to firmly guide the material, but not so tight that they bind.

Do not leave the hand crank engaged on the pin of the adjusting shaft. It could move through vibration and cause the machine to lose its adjustment. Return it to the hanger provided at the back of the machine, not shown.

5. Move the mill roll until it is centered with the guide rails 73. Place the mill roll guides against the roll and tighten the set screws.

6. Set the batch counter control previously discussed, to the desired number of frames plus two or three.

7. Set the length controllers, 81, 82, 83 and 84 as described above.

8. Turn the main power switch on.

9. Put the jog/run switch in the jog position.

10. Place the eject system in the one position. The length knife, 31 should now be down. If it is not, depress the stop button.

11. Push the leading edge of the material into the machine until it is against the length knife, 31.

12. Turn the eject system switch off.

13. If pinch type frames are desired, move the lever, 56 so it points toward the back of the machine. If square frames are desired, leave the lever pointing toward the front of the machine. This lever is located directly above the pinch-score rollers, 23 and 24.

14. Using the start/jog button, jog the machine until the leading edge of the material is a few inches past the discharge end of the machine.

The machine is now ready to run.

15. Place the jog/run switch in the run position and depress and start/jog button.

16. Whenever the machine stops, the leading edge must be jogged through the fold rolls before starting to run. If this is not done, a short piece will be cut off and will cause the machine to malfunction.

The machine can be stopped by depressing the stop button or by lifting the hinged guard, not shown. If a jam occurs, the jam switch should stop the machine. When the number of frames set on the batch counter have been run, the machine will stop automatically.

To remove the material from the machine or to clear jams, put the jog/run switch in the jog position and turn the eject system switch on. This will cut the material and release it from the infeed rollers so it can easily be removed. Jog the machine to remove the piece left in the machine.

Although the embodiment above described is preferred, various modifications may be made on the structure shown and described without departing from the spirit and scope of the invention.

I claim as my invention:

1. An apparatus for the formation of rectangular frames for filters from a reel of framestock wherein sections of framestock are cut, notched and fed through the apparatus without stopping comprising:

a. an elongated frame;

b. a pair of opposing infeed rollers mounted rotationally on said frame which advance a continuous strip of framestock into the apparatus c. a series of guide rails mounted lengthwise on said frame to maintain a proper position of the framestock;

d. a pair of engageable opposing pinch-score rollers slidingly mounted to the frame downstream to said infeed rollers through which the framestock passes which pinch and score the framestock when engaged;

e. means for adjusting the location of the pinch-score rollers relative to the width of the framestock, said means mounted on the frame and connected to the pinch-score rollers;

f. first means for cutting the framestock to a predetermined length, said means mounted downstream to the pinch-score rollers;

g. second means for cutting three notches in the framestock at predetermined positions along the length of the framestock, said means mounted downstream to first cutting means;

h. a second set of rotationally mounted opposing outlet rollers mounted on said frame downstream to second cutting means through which the framestock passes and is pre-folded;

i. a third set of rotationally mounted opposing fold rollers mounted on the frame downstream to cutting means through which the pre-folded framestock passes;

j. means for adjusting the position of the second fold rollers relative to the width of the framestock;

k. a discharge surface mounted to the frame on the end opposite the feeding means onto which the framestock, notched, folded and cut to length is discharged;

l. means for supplying power to the apparatus mounted on a said frame; and m. means for controlling the operation of cutting means g and f to set the position of the respective notches along the length of framestock and to set the length of each frame, respectively.

2. The apparatus of claim 1 wherein the opposing infeed rollers, b are driven by power means, l for a number of revolutions equivalent to a desired frame length.

3. The apparatus of claim 2 wherein each activation of the cutting means, f, causes a corresponding relaxation between rollers, b, which otherwise drive the strip of framestock thereby creating a gap in the strip of framestock between each length.

4. The apparatus of claim 3 wherein said control means is an electric eye activated by said gap.

5. The apparatus of claim 4 wherein the second set of fold rollers h comprise an upper roller with a circumferentially located protrusion and a knurled surface and a lower roller with a circumferentially located goove accommodatingly larger than the protrusion whereby a fold and bead is formed in the framestock along its length.

6. The apparatus of claim 5 wherein said pinch-score rollers further comprise upper pinch-score rollers and lower pinch-score rollers wherein the upper pinch-score roller structure comprises a first diameter and a second smaller diameter with a gradual bevel communicating there between and the lower pinch-score roller is opposingly mounted so that it meets the upper roller at the point the bevel meets the smaller diameter of the upper roller whereby the material passing between is bent and scored.

7. The apparatus of claim 6 wherein said frame is enclosed in a removable transparent cover.

* * * * *